US006651419B2

(12) United States Patent
Casas

(10) Patent No.: US 6,651,419 B2
(45) Date of Patent: Nov. 25, 2003

(54) MECHANISM FOR CUTTING A THREAD RESERVE OF SPINDLES IN CONTINUOUS SPINNING MACHINES

(75) Inventor: Alberto Verdaguer Casas, Curb (ES)

(73) Assignee: Electro-Jet, S.A., Curb (ES)

( * ) Notice: Subject to any disclaimer, the term of this patent is extended or adjusted under 35 U.S.C. 154(b) by 22 days.

(21) Appl. No.: 09/947,017

(22) Filed: Sep. 5, 2001

(65) Prior Publication Data

US 2002/0050132 A1 May 2, 2002

(30) Foreign Application Priority Data

Oct. 26, 2000 (ES) ..... 200002578

(51) Int. Cl.[7] ..... B65H 73/00
(52) U.S. Cl. ..... 57/306; 57/303; 28/295
(58) Field of Search ..... 28/292, 295, 298; 57/300, 303, 306; 242/487.1, 487.6, 487.7, 487.8, 487.9

(56) References Cited

U.S. PATENT DOCUMENTS

| | | | | | |
|---|---|---|---|---|---|
| 3,426,518 | A | * | 2/1969 | Winter et al. | 57/306 |
| 4,208,865 | A | * | 6/1980 | Koella, III | 57/303 |
| 5,479,770 | A | * | 1/1996 | Bothner et al. | 57/303 |
| 5,579,630 | A | * | 12/1996 | Inverardi | 57/305 |

FOREIGN PATENT DOCUMENTS

| | | | | | |
|---|---|---|---|---|---|
| DE | 3213755 | A1 | * | 2/1984 | D01H/11/00 |
| JP | 59047431 | A | * | 3/1984 | D01H/1/38 |

* cited by examiner

*Primary Examiner*—John J. Calvert
*Assistant Examiner*—Shaun R Hurley
(74) *Attorney, Agent, or Firm*—Michael J. Striker

(57) ABSTRACT

A mechanism for cutting a reserve of thread of spindles of continuous spinning machines has a cutting blade, an element which is draggable and which is adjustable without contacting an area of a spindle where there exists a thread of a reserve to be cut and removed, and a device for regulating an adjustment of the element.

12 Claims, 8 Drawing Sheets

MECHANISM FOR CUTTING A THREAD RESERVE OF SPINDLES IN CONTINUOUS SPINNING MACHINES

BACKGROUND OF THE INVENTION

The present invention relates to a mechanism for cutting a thread reserve of the spindles in a continuous spinning machine, which can secure a quick, effective and clean system for this operation.

When the continuous spinning machines were developed, it was necessary to replace the tubes already filled with thread with new clean tubes in an operation called "doffing-and-replacing" which was carried out by hand. This operation was modernized to become automatic in that the thread begins to be wound on the tube without hand intervention. At the moment when the doffing-and-replacing ends, before withdrawing the tube filled with a thread, some turns of them are wound, approximately within three and seven, at the lower part of the spindle. These turns of the thread are called "reserve", which thereafter shall be removed. Then the tube with the thread is replaced with a new empty tube, and a new cycle starts automatically. It is then necessary to cut the reserve and to clean the spindle so that no debris of thread remain which could hinder the following automatic replacement of the tube.

For cutting of the reserve, several kinds of mechanisms have been developed. One of them is an individual mechanism for a spindle attached to a continuous machine, such as for example a thin film fixed in front of the spindle and driven by the traveling cleaning mechanism. The other mechanism is common to several spindles and is attached on the continuous machine, so that it travels through guideways located along the whole length of the continuous machine in front or on the rear of the spindles eliminating the reserve. These mechanisms can be driven by a device of the continuous machine or by an external element, such as for example a traveling cleaning device arranged over the continuous machine. All these mechanisms however are characterized by difficult regulation, high maintenance cost and low effectiveness, especially due to the difficult alignment of the guideways with respect to the spindles and their guide length which exceed 40 meters.

SUMMARY OF THE INVENTION

Accordingly, it is an object of the present invention to provide a mechanism for cutting a thread reserve of spindles in continuous spinning machines, which avoids the disadvantages of the prior art.

It is a further object of the present invention to provide a mechanism of the above mentioned general type, which cleans the reserves and secures that the spindle remains clean, in a simple and greatly efficient way.

In keeping with these objects and with others which will become apparent hereinafter, one feature of present invention resides, briefly stated, in a mechanism for cutting a reserve of thread of spindles of continuous spinning machines, comprising a cutting blade; an element which is draggable and which is adjustable without contacting an area of a spindle where there exists a thread of a reserve to be cut and removed; and means for regulating an adjustment of said element.

When the mechanism is designed in accordance with the present invention, it is formed as a single mechanism which is common to all spindles of one phase of the continuous machine, and for its displacement it is dragged by a second mechanism of the continuous machine or by an external element, such as a traveling cleaning mechanism as in the already existing systems.

The present invention is not affected by either the amount of spindles to be simultaneously cleaned, or the amount of spindles for which a single displaceable mechanism is applied or the way of dragging.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
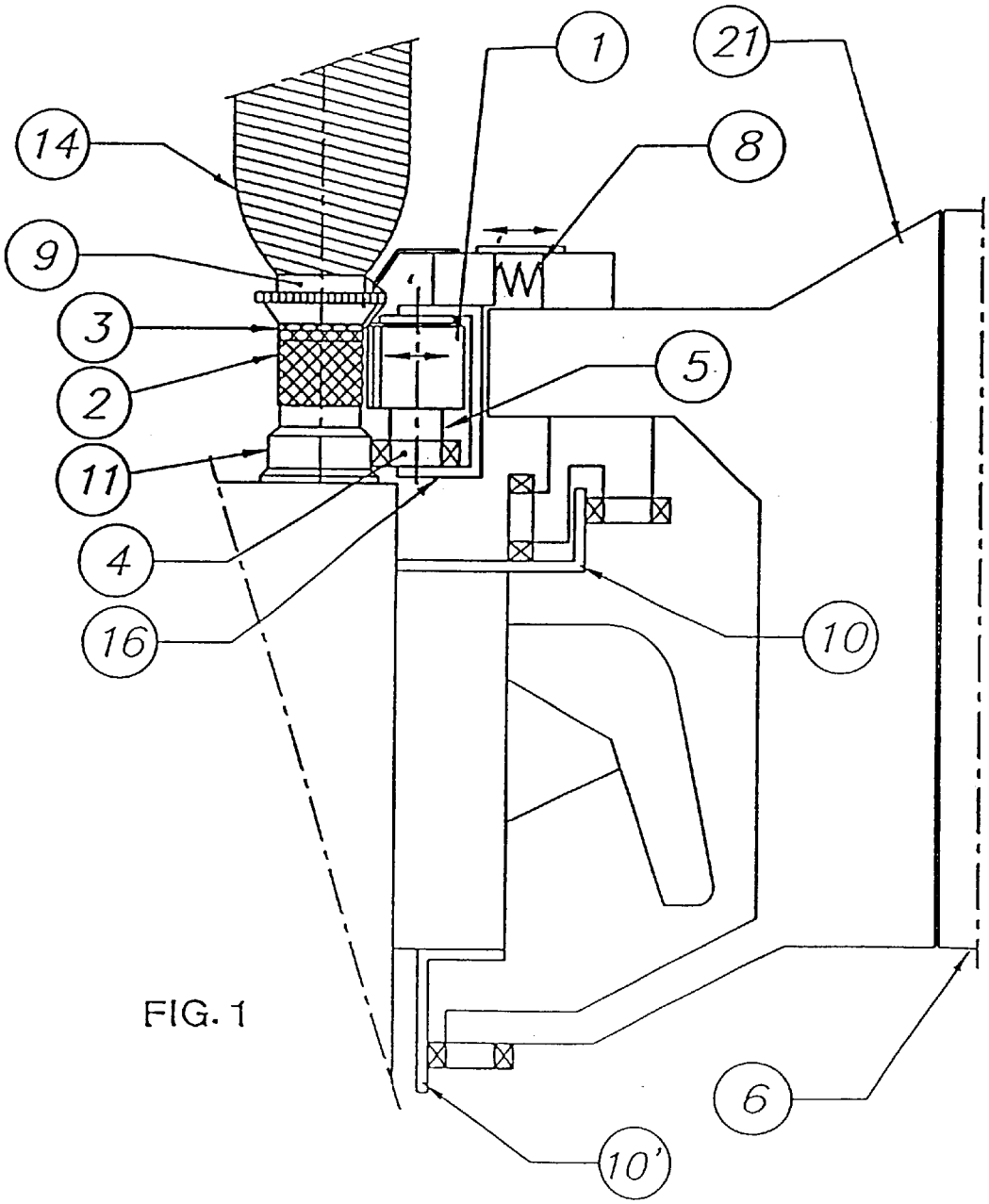
FIG. 1 is a side view schematically showing an external dragging element and the area of contact of a guiding element with a lower cylindrical part with a spindle of the inventive mechanism.

A mechanism for cutting a thread reserve of spindles in a continuous spinning machine has a cylinder-shaped element 1 which is either composed of steel 9, or coated with a slightly abrasive material, or is composed of metal with a final superficial treatment, or of some non-metallic material depending on its construction.

Depending on the kind of thread 14 (cotton, etc.), the above mentioned element can adapt one or another shape and one or another superficial finish. It can freely rotate, or can be driven or fixed. This element is a part of the mechanism which is suitably adjusted without contacting the area 2 of the spindle 9, where the thread 3 to be removed, called reserve, exists.

The adjustment is regulated by a spring or an element for providing pressure 8, a second element roller or guiding bearing 4 depending on the construction, the parts 5 for fastening them, and the support 16 attached to the frame 21 of the cleaning element which in turn is fixed on the dragging element 6 or 15.

A guiding part for such as a roller or a rotating bearing or a flat part, etc. is provided. In the event that the element 1 and the guiding element 4 are cylinder-shaped, both elements can have a common axis or not, according to the construction and the type of the continuous machine. The spindles 9 of the machine can be slightly out of alignment with each other. The guideways 10 and 10' which support the clearing mechanism called also mouse, can be also out of alignment. Therefore the cutting elements for the reserve developed up to now can not secure a correct and suitable adjustment between the element 1 and each of the spindles 9, remaining too seperated from some of the spindles which thus are not cleaned, or too close to other spindles so as to come in contact with the risk of damaging the mechanism or the spindle.

The guiding element comes to directly and tangentially contact a copying part of the outline of the lower area 11 of the spindle 9 at its front or rear end. This part is generally cylindrical and forms a continuation with a similar cylindrical part 2 where the thread 3 to be cleaned is fixed. The spindle 9 or the guiding element 4 comes to contact with an equivalent element 12, by means of which it can copy and know the accurate position of the spindle and which can be fixed for example in the spindlehead or bed, which has movement or not.

Figure 2:
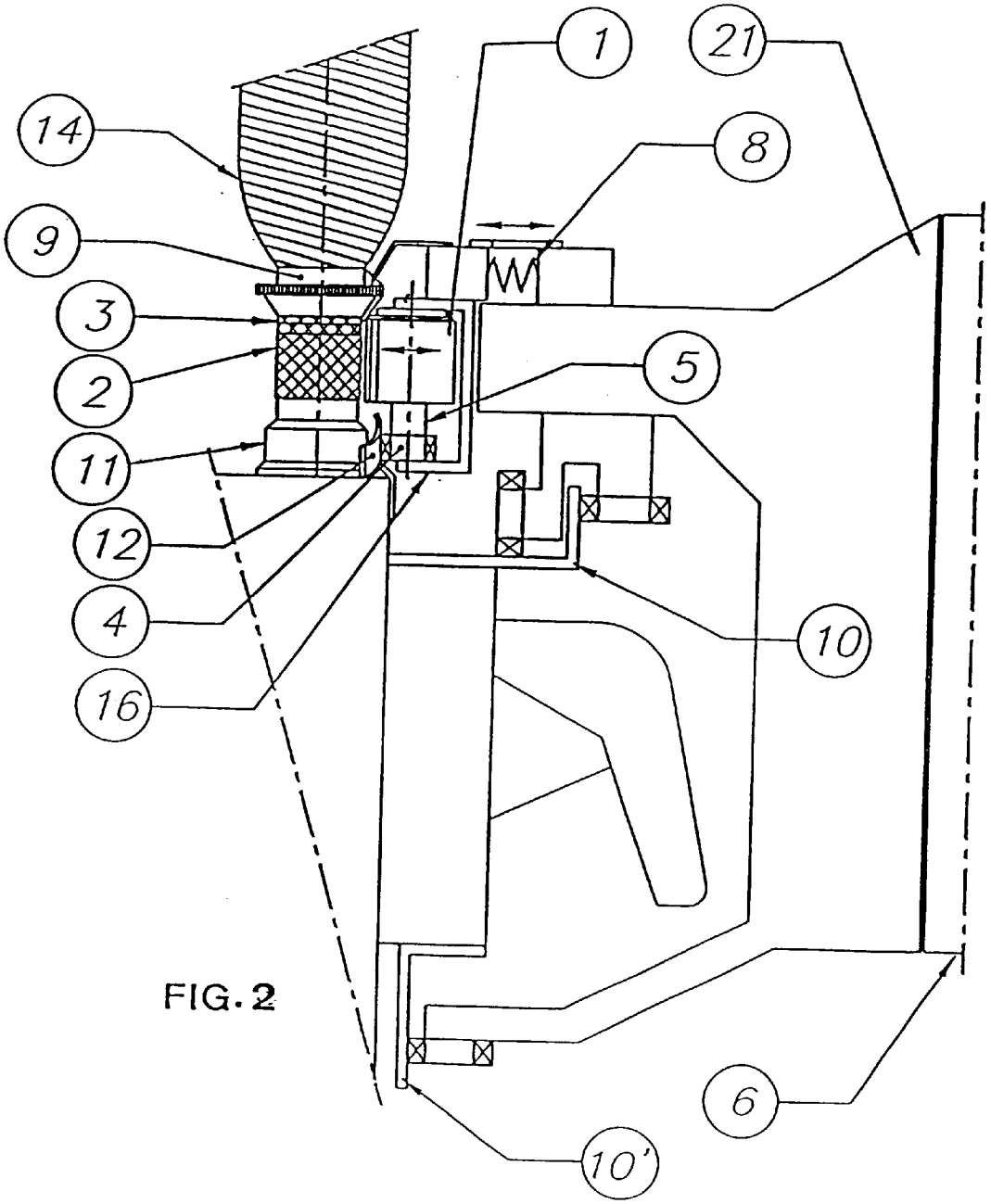
FIG. 2 is a view substantially corresponding to the view of FIG. 1 of the internal dragging element in the area of contact of the guiding element which prevents a direct contact with the lower cylindrical part of the spindle.

The roller 4 then accurately copies the position of each spindle 9, locating itself at the position which always secures the correct adjustment between the element 1 and the area 2 of the spindle 9 where the thread to be cleaned or the reserve 3 is located. Thus, for copying of each spindle, the roller 4 can contact the cylindrical lower part 11 of the spindle 9 itself, or an equivalent element 12 as shown in FIG. 2, which allows to carry out the same "position copying" functions. Applying the roller 4 in the lower part of the spindle or on the equivalent wrapping element 12 does not limit the object of the present invention.

A spring or a similar pressing element 8 allows that the cleaning assembly and copier proper recovers the position. In addition, it allows the movement between the assembly support 16 and the frame 21. The spring allows to accurately copy the position of each spindle 9. Finally, a cutting element or blade is provided for the thread 3.

Figure 5:
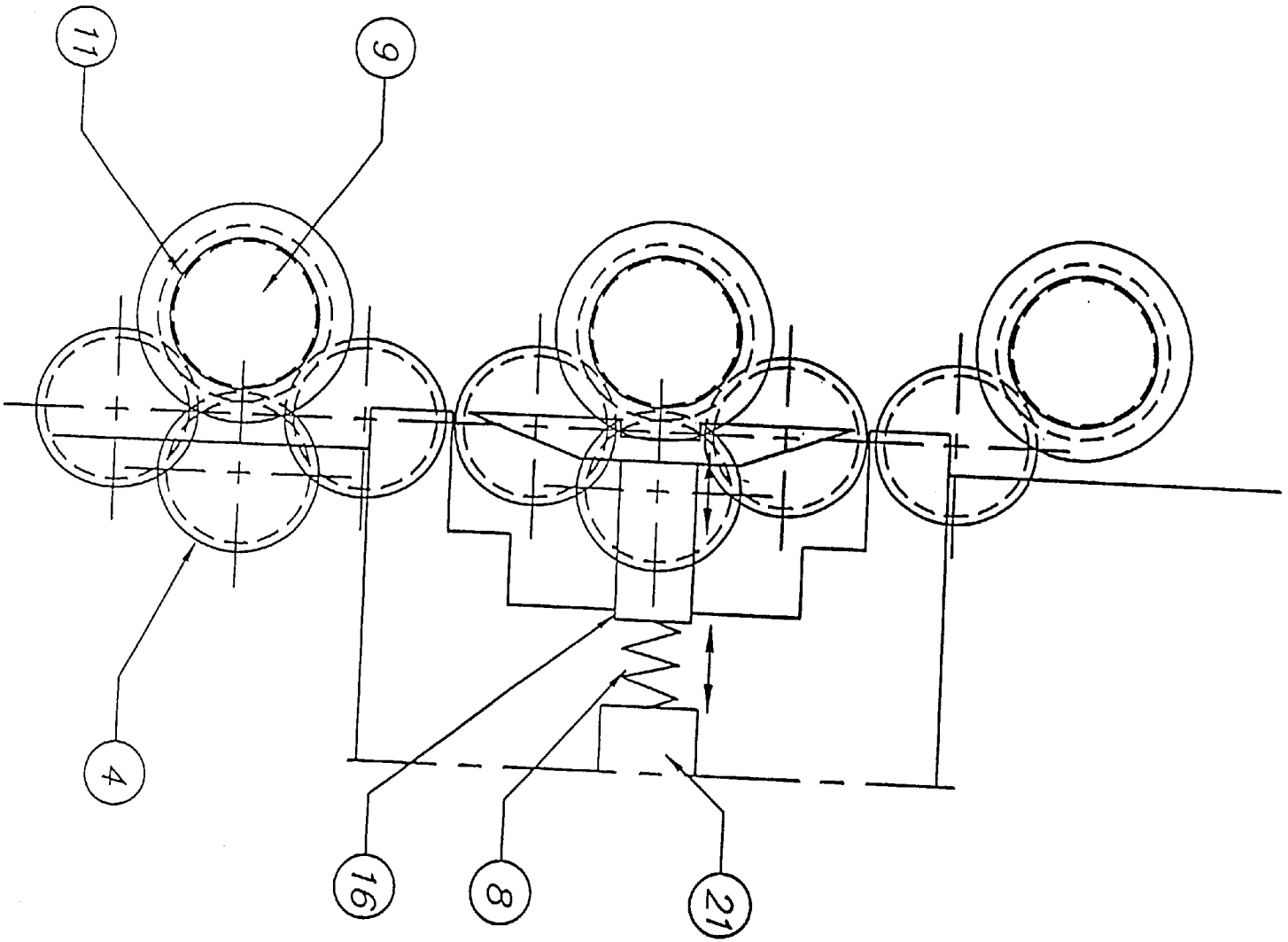
FIG. 5 is a schematic plan view of a roll spindle and a roller which is moving copying the spindle or a protecting guideway as well as the dragging element of the mechanism.

FIG. 5 schematically illustrates the way the spindles 9 or equivalent element 12 copies by means of the roller or guiding bearing 4.

The above disclosed mechanism allows to copy the spindle accurate position. In the event that the mechanism loses its vertical position shown in FIGS. 3 and 4, with the sham axis 19 it would not recover it. The vertical position can be lost, depending on the guiding system for the cleaning mechanism which can be installed in each kind of continuous machine, so that a mechanism for recovering the vertical position has been provided. This mechanism is optional and can be used or not.

Figure 3:
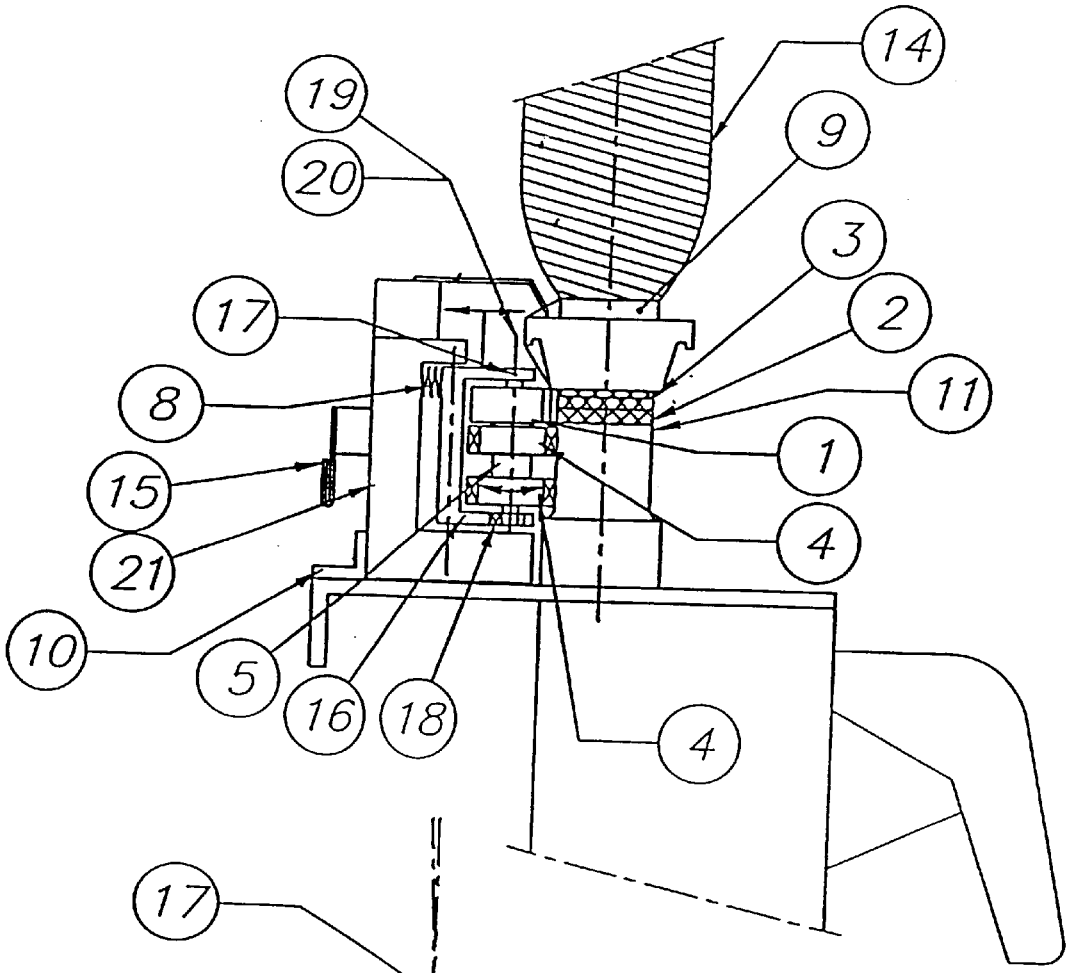
FIG. 3 is a view showing the dragging element of the continuous machine at its rear part in accordance with the present invention.
Figure 4:
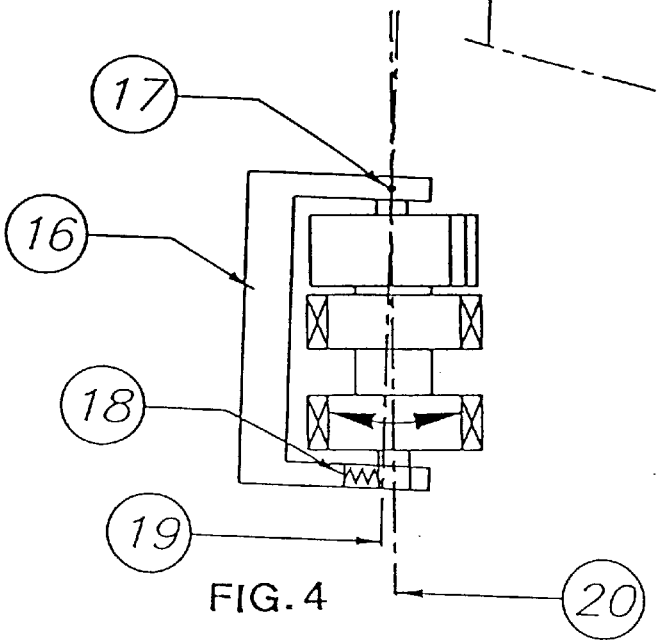
FIG. 4 is a view showing an enlarged detail of the dragging element of the continuous machine of FIG. 3.

The mechanism for recovering the vertical position is located close arranged to the cleaning mechanism. To the already known cleaning mechanism, a rotating movement with respect to the location point 11 and the spring or pressing element 18 are added as shown in FIGS. 3 and 4. When the spring 18 applies pressure and the cleaning mechanism is not located in front of any spindle, the axis 20 which is common to the cleaning mechanism and the guiding rollers 4 remains inclined with respect to the sham axis 19 as shown in more detail in FIG. 4. Then, when the roller or guiding bearing 4 contacts a spindle 9 or equivalent element 12 by the spring or pressing element 11 and the relation of movement between the different elements of the system, such as the actual axis 20 and the sham axis 19 coincides again, the mechanism remains fully parallel to the axis of the spindle as shown in FIG. 3.

As explained herein above, the main feature of the present invention is that the mechanism for cutting and cleaning the reserve copies the accurate position of the spindle either by directly contacting the spindle or by contacting another part or element which has a concrete accurate position with respect to the spindle. The present invention is not limited to any of corresponding mechanisms, but instead deals with the idea of copying the position of the spindle by means of the mechanism or similar one. In connection with this, some modifications of the inventive mechanism within the spirit of the present invention are possible.

Figure 6:
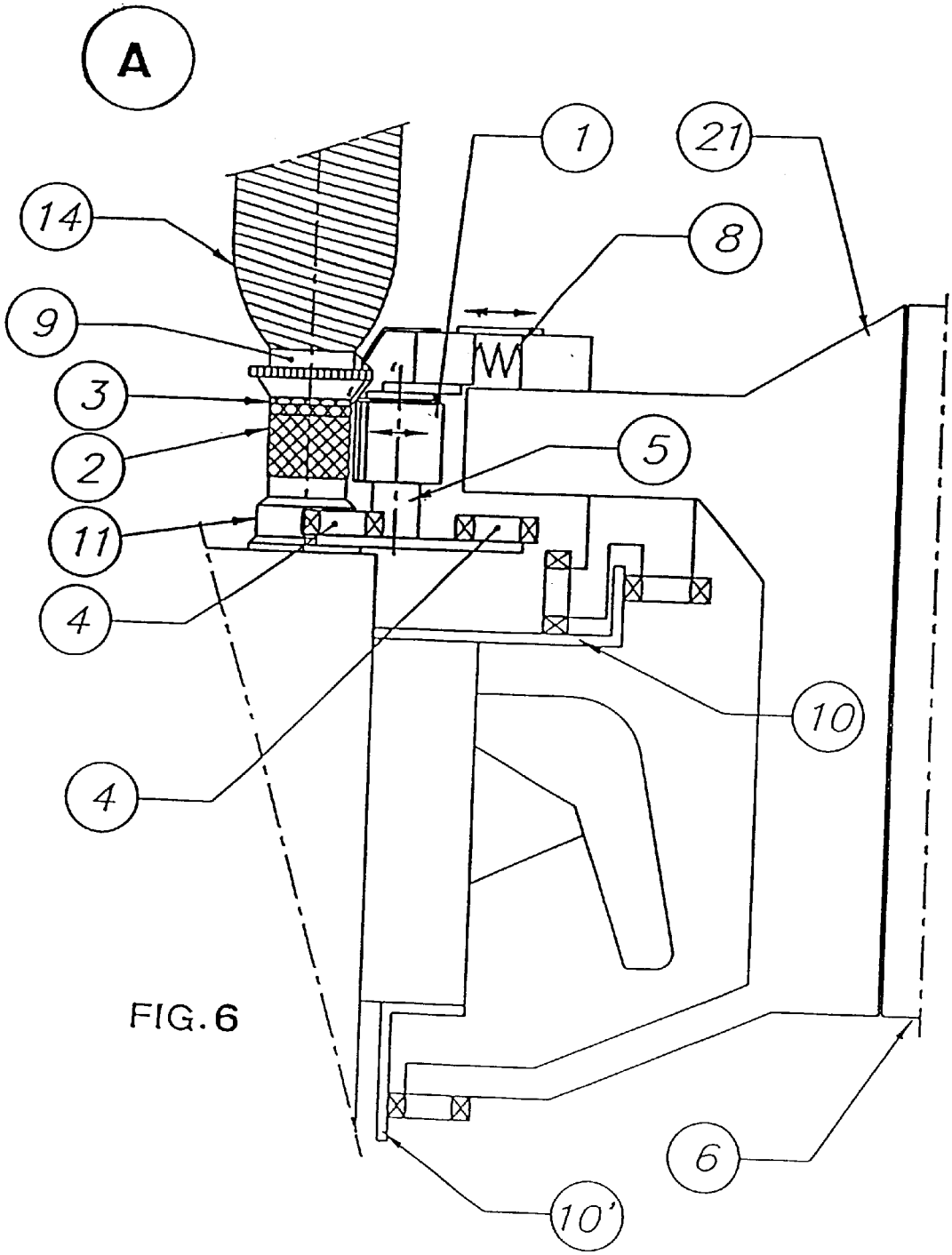
FIGS. 6 and 7 show a further embodiment in a schematic side view of a triangle-shaped external dragging element in a schematic plan view in a row of spindles.
Figure 7:
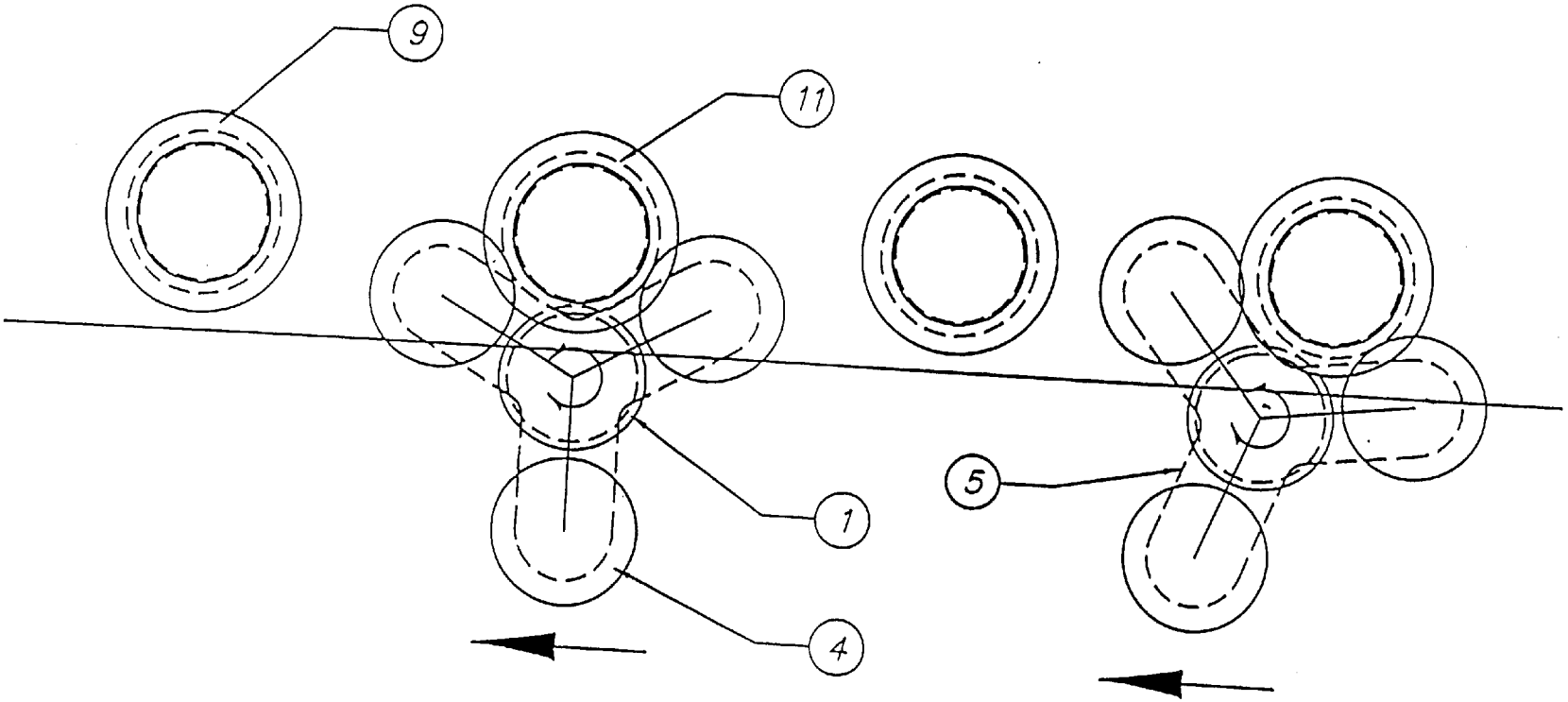

A triangle-shaped mechanism can be utilized, with the sides which are slightly curved to take the exact shape of the spindle or the element used for being positioned with respect to the spindle, so as to carry the same function as the above mentioned element with the roller or guiding bearing 4. Together with the triangle-shaped element, a second element for protrusion of the triangle will carry out the same functions as the above mentioned element 1. The triangle-shaped element will rotate in that case on a point located over the part and at the same time it will move forward along the continuous machine for cleaning the reserve of the spindle, as shown in FIGS. 6 and 7.

A mechanism for simultaneously cleaning several spindles can be provided in accordance with another embodiment. For each spindle to be simultaneously cleaned, an approximately half-arched-shaped part is made, which is formed of two parts. One part is used for cleaning the spindle and is equivalent to the element 1 and the other part is equivalent to the roller or guiding bearing 4 for copying the position of the spindle or the element which is equivalent to the element 12 to allow to position the mechanism with respect to the spindle taking the shape thereof.

Figure 8:
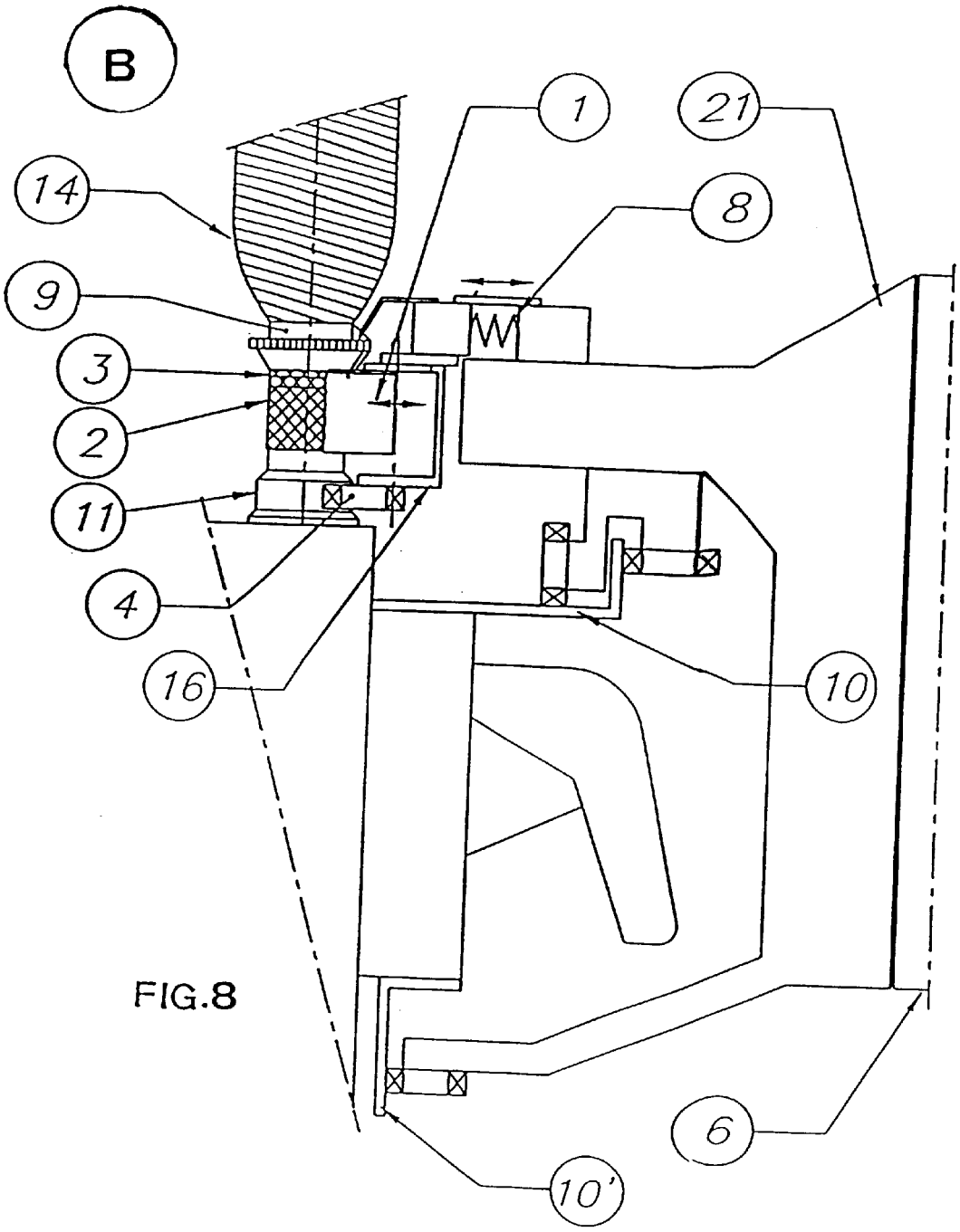
FIGS. 8 and 9 are views showing a further embodiment of the inventive mechanism for simultaneously cleaning several spindles.
Figure 9:
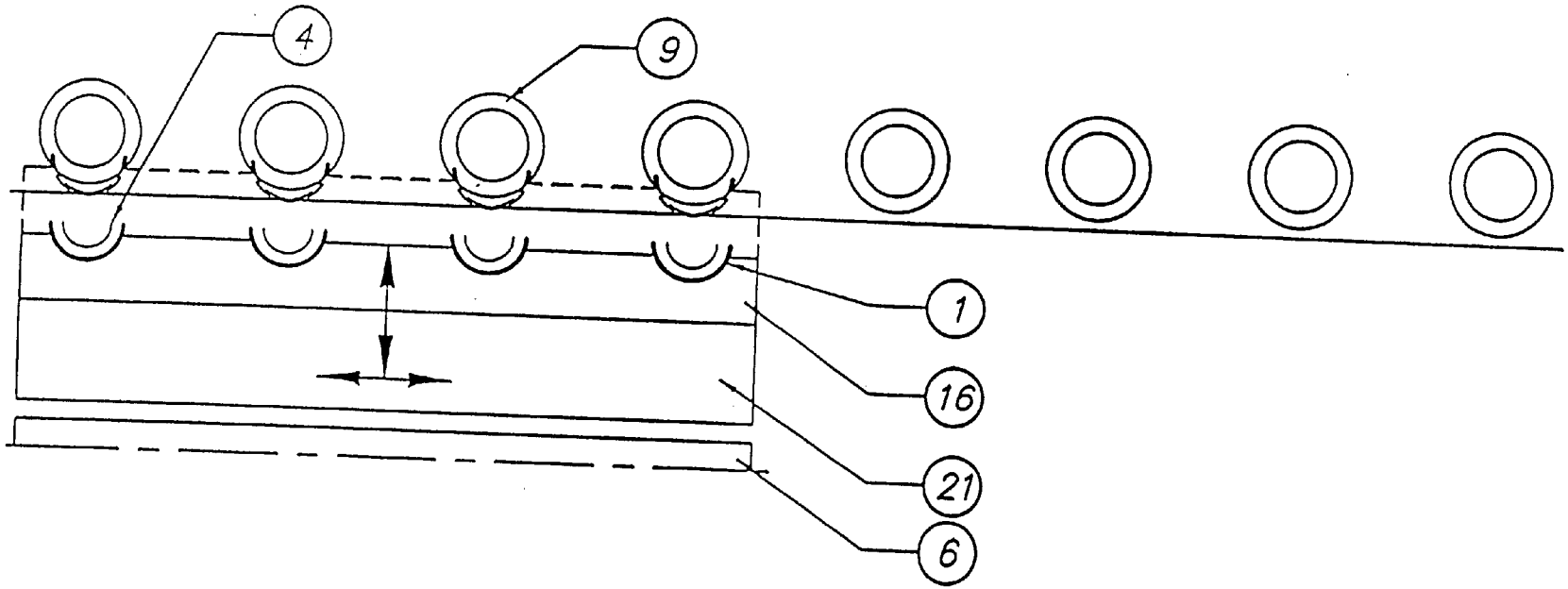

Each of the half-arched part are attached to a common frame, and then the whole assembly can be moved toward the spindle for copying the position of the spindle, by matching different moves pressing elements if required. Also, the spindle can be taken apart from the spindle by a small move of a few millimeters, for escaping from the spindle, which allows to move a step forward and to clean the following group of spindles. This embodiment is illustrated in FIGS. 8 and 9.

It will be understood that each of the elements described above, or two or more together, may also find a useful application in other types of constructions differing from the types described above.

While the invention has been illustrated and described as embodied in a mechanism for cutting a thread reserve of spindles in continuous spinning machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A mechanism for cutting a reserve of thread of spindles of continuous spinning machines, comprising an element which is draggable and which is adjustable without contacting an area of a spindle where there exists a thread of a reserve to be cut and removed; means for regulating an adjustment of said element; and a screen-like element partly confined to a lower area of a spindle, said regulating means including a guiding element which contacts said screen-like element, copying thus exactly a position of each spindle, and locating itself at the position which secures a correct adjustment between said element and said area of the spindle where is located the thread of the reserve to be removed.

2. A mechanism as defined in claim 1, wherein said element is formed as a cylinder-shaped element.

3. A mechanism as defined in claim 1, wherein said element is formed as an element selected from the group consisting of an element composed of steel, an element coated with a slightly abrasive material, an element composed of metal with a final superficial treatment, and an element composed of a non metallic material.

4. A mechanism as defined in claim 1, wherein said element is freely rotatable about its vertical axis.

5. A mechanism as defined in claim 1, wherein said regulating means include an element selected from the group consisting of a spring, an element exerting a pressure, a roller element, a guiding bearing, fastening parts, and a support fixed on a frame of a cleaning element which is fixed on dragging means.

6. A mechanism as defined in claim 1, wherein said regulating means include an element exerting a pressure.

7. A mechanism as defined in claim 1, wherein said regulating means include a guiding element formed to directly and tangentially contact an outline of a lower area of a spindle thus copying a part of the outline which forms a continuation of a top part on which a thread of the spindle to be cut and cleaned is fixed.

8. A mechanism for cutting a reserve of thread of spindles of continuous spinning machines, comprising an element which is draggable and which is adjustable without contacting an area of a spindle where there exists a thread of a reserve to be cut and removed; means for regulating an adjustment of said element; a spring element which is not pressing when it is not located in front of any spindle; and a bearing adapted to contact a spindle or equivalent element so that said spring element and a relation of movement between different elements of the mechanism, and an actual axis and a sham axis coincide, the mechanism remains fully parallel to the axis so that said element copies an accurate position of each spindle by directly contacting the spindle or an equivalent element which has an accurate and concrete position with respect to related spindle.

9. A mechanism for cutting a reserve of thread of spindles of continuous spinning machines, comprising an element which is draggable and which is adjustable without contacting an area of a spindle where there exists a thread of a reserve to be cut and removed; means for regulating an adjustment of said element; guideways supporting said mechanism; and a mechanism for recovering a vertical position when spindles of the machine can be slightly out of alignment with each other and also said guideways supporting said element, said mechanism for recovering the vertical position being located close to said element.

10. A mechanism for cutting a reserve of thread of spindles of continuous spinning machines, comprising an element which is draggable and which is adjustable without contacting an area of a spindle where there exists a thread of a reserve to be cut and removed; and means for regulating an adjustment of said element, wherein said element is operative for adapting a 120° triangular wing shape with ends forming cylinders which take a shape of a spindle or an equivalent element, so as to carry out copying, said triangular cleaning mechanism rotating about a point and movable forward so that it is displaceable along the machine for cleaning a reserve of each of the spindles of a row.

11. A mechanism for cutting a reserve of thread of spindles of continuous spinning machines, comprising an element which is draggable and which is adjustable without contacting an area of a spindle where there exists a thread of a reserve to be cut and removed; means for regulating an adjustment of said element; and a substantially half-arched-shaped part formed by two parts for simultaneously cleaning several spindles, including one part for cleaning a spindle which is equivalent to the one part and another part which is equivalent to a bearing for copying a position of the spindle or an equivalent element, so as to position the mechanism with respect to the spindle and to take its shape.

12. A mechanism as defined in claim 11, and further comprising a common shape to which said half-arch-shaped parts are fixed so that they together can move forward the spindle for copying a position of the spindle, and also are rotatable apart from the spindle, to allow movement a step forward and cleaning of a following group of spindles.

* * * * *